United States Patent [19]

Alexoff

[11] Patent Number: 4,616,500

[45] Date of Patent: Oct. 14, 1986

[54] METHOD FOR PRODUCING TUBING OF VARYING WALL THICKNESS

[75] Inventor: Randall L. Alexoff, Youngstown, Ohio

[73] Assignee: George A. Mitchell Company, Youngstown, Ohio

[21] Appl. No.: 704,755

[22] Filed: Feb. 25, 1985

[51] Int. Cl.[4] ..... B21C 1/24

[52] U.S. Cl. ..... 72/283; 72/276

[58] Field of Search ..... 72/260, 263, 276, 283, 72/282

[56] References Cited

U.S. PATENT DOCUMENTS 2,228,301 1/1941 Ditzel et al. ..... 72/276

3,271,987 9/1966 Douthett et al. ..... 72/283

FOREIGN PATENT DOCUMENTS 53-77868 7/1978 Japan ..... 72/276

*Primary Examiner*—W. D. Bray

*Attorney, Agent, or Firm*—Thomas H. Murray

[57] ABSTRACT

A method for producing tubing of variable wall thickness, and particularly for producing double-butted tubing, wherein the wall thickness or gage at the ends of the tube is greater than that in the intermediate portion of the tube. This is accomplished by threading the tube over a mandrel, usually having a removable plug at one end thereof, until a portion of the plug passes through a necked-down end of the tube, pushing the tube and the mandrel through a die, and thereafter pulling the removable plug and the tube from the mandrel while causing the outer periphery of the tube to pass through a die.

13 Claims, 30 Drawing Figures

METHOD FOR PRODUCING TUBING OF VARYING WALL THICKNESS

BACKGROUND OF THE INVENTION

As is known, it is quite common to produce tubing by cold-drawing techniques wherein the wall thickness of the tubing is constant throughout its length. Both the inner and outer diameters of a tube can be reduced or expanded together; however it is uncommon to provide tubing in which the wall thickness varies along its length. This is true particularly in the case of tubing of constant outer diameter but a wall thickness which is greater at the ends of the finished tube than in the portion of the tube intermediate its ends. This is for the reason that such tubing is normally formed as it passes through a die over a mandrel. There is no way of pulling the tube over a mandrel in a drawbench, for example, if it is desired to produce a tube with an inner diameter smaller than that of the mandrel at the end through which the mandrel must exit.

While it is uncommon to produce tubing of varying wall thickness, there are applications for tubing of constant outer diameter in which the gage or thickness of the tube wall is greater at its ends than at its intermediate portion. One such application is a bicycle frame wherein the wall thickness is preferably light intermediate the ends of a tubular frame member to facilitate light weight and a degree of flexibility, but wherein the wall thickness at the ends of the frame members must be greater to facilitate connection (e.g., by welding) to other frame members.

In the past, methods have been devised for producing tubing of variable internal diameter of the type described above; however these methods are cumbersome, expensive and not altogether satisfactory.

SUMMARY OF THE INVENTION

In accordance with the present invention, a method is provided for producing tubing of variable wall thickness along its length, and particularly tubing of constant outer diameter but an inside diameter which is smaller at the ends of the tubes than at the intermediate portion opposite the ends of the tube.

Specifically, the invention provides a method for producing tubing having a variable wall thickness along its length which comprises nosing-down an end of a tube of constant wall thickness to produce an opening in one end of a tube which is of smaller cross-sectional area than the remainder of the tube. The tube with the necked-down portion is then threaded over a mandrel having a removable plug at its forward end until a portion of the plug extends through the nosed-down end. The tube, with the mandrel inserted, is then pushed through a die to cause the tube to extrude while reducing its outer periphery and while causing the inner periphery of the tube to conform to the periphery of the mandrel. This occurs by virtue of the plasticity or ductility of the steel or other metal from which the tube is formed. Finally, a removable plug and the tube are pulled from the remainder of the mandrel while the outer periphery of the tube is caused to pass through a die. As the tube is pulled over the mandrel, which now has a larger diameter than the inner diameter at one end of the tube because of the extrusion process, the tube inner and outer diameters expand. However, as the tube continues to pass through the die after the mandrel is removed, both the inner and outer diameters are reduced, thereby producing a tube of constant outer diameter which has a gage or thickness at its ends greater than at the intermediate portion of the tube.

In one embodiment of the invention, a single die is employed, meaning that the tube must first be pushed through the die, then retracted, and thereafter pulled by gripping the aforesaid removable plug to strip the tube from the mandrel while the tube again passes through the die. In other embodiments, two dies can be used in tandem, which eliminate the necessity for retracting the tube through a single die.

The invention is also capable of producing a tube having an increased wall thickness at one end and an enlarged outer diameter at its other end by stopping the pulling process and by thereafter pulling the tube backwardly through the die.

The above and other objects and features of the invention will become apparent from the following detailed description taken in connection with the accompanying drawings which form a part of this specification, and in which.

Figure 1A:
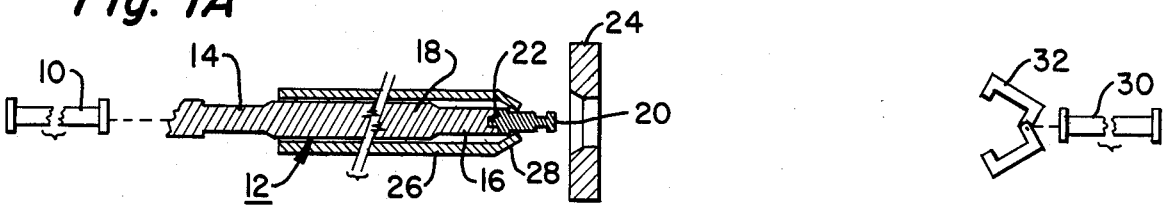
FIGS. 1A–1F illustrate one embodiment of the invention employing a single die.

With reference now to the drawings, and particularly to FIGS. 1A–1F, there is shown a sequence for extruding double-butted and single-butted tubes (i.e., tubes having a constant outer diameter and an increased wall thickness at its opposite ends). It includes a first hydraulic cylinder 10 having connected to its piston rod a mandrel 12. The mandrel 12 has a reduced diameter portion 14 at its left end, a reduced diameter portion 16 at its right end, and an enlarged diameter portion 18 intermediate the ends 14 and 16. The forward end of the mandrel 12, and particularly the right reduced-diameter end 16, carries a removable plug 20 which may, for example, have a shortened dowel 22 at its rearward end which fits into a cooperating bore on the foreward end of the reduced diameter portion 16.

In the drawings, the mandrel 12 is shown aligned with a die 24; however in actual practice it can be rotated upwardly or to the side and out of alignment with the die. As it is moved out of alignment with the die, a tube 26 of constant wall thickness is threaded over the mandrel 12 and the removable plug 20 into the position shown in FIG. 1A. It should be noted that the forward and of the tube 26 is necked-down as at 28 such that it cannot pass over the removable plug 20. The necking-down process can be carried out, for example, with a tube pointer such as that shown in U.S. Pat. No. 3,572,080.

Figure 1B:
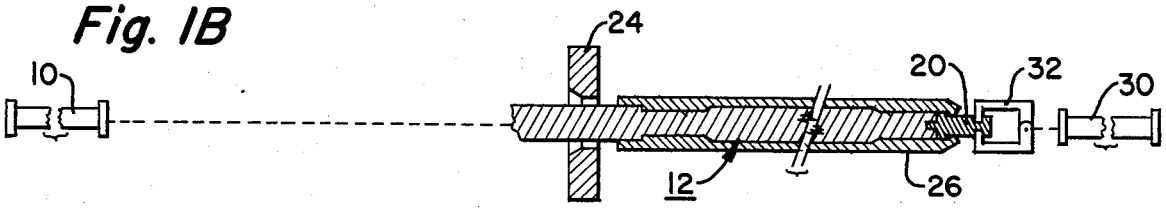

After the tube 26 has been threaded over the mandrel 12, the mandrel and tube are moved into alignment with the axis of the die 24. Thereafter, the cylinder 10 is pressurized to push the mandrel and the tube through the die 24 which is fixed in position, causing the outer diameter of the tube to assume a uniform diameter and an inner diameter which conforms to the premachined profile of the mandrel. This is shown in FIG. 1B where the mandrel and the tube have been pushed through the stationary die 24. As the tube is pushed through the die, it is extruded and elongated with its outer diameter being reduced. At the same time, due to the plasticity and/or ductility of the tube, its inner diameter is forced to conform to the periphery of the mandrel 12. In this process, note that in FIG. 1B, a tube of constant outer diameter is produced, but one with an inner diameter which is greater at its intermediate portion than at its opposite ends, the ends having a greater wall thickness than the intermediate portion. In this step of the process, it will be noted that the mandrel cannot be readily removed from the tube due to the reduced inner diameters at its opposite ends.

Figure 1C:
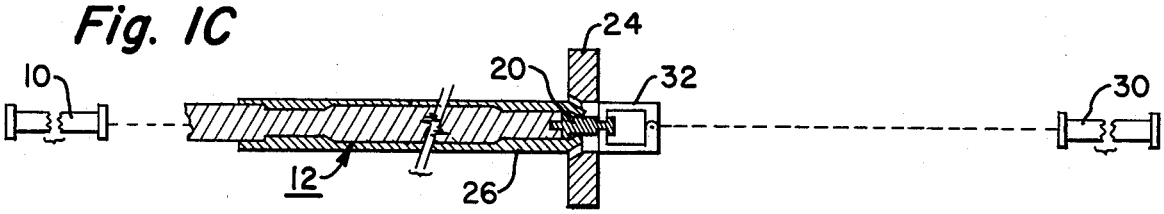

Following the extrusion of the tube and pushing it through the die as shown in FIG. 1B, the tube is then retracted by the cylinder 10 into the position shown in FIG. 1C where its nosed-down portion 28 passes through the die. At the same time, the leftward movement of the mandrel 12 is stopped at a point where the right end of the removable plug 20 extends through the die 24.

On the side of the die opposite the cylinder 10 is a second cylinder 30 which carries on its piston rod a gripper or clamp 32. Since the tube and mandrel are in the position shown in FIG. 1C, the cylinder 30 is pressurized to move the gripper 32 to the left as shown in FIG. 1C. The gripper 32 is then caused to grip the reduced diameter portion of the removable plug 20.

Figure 1D:
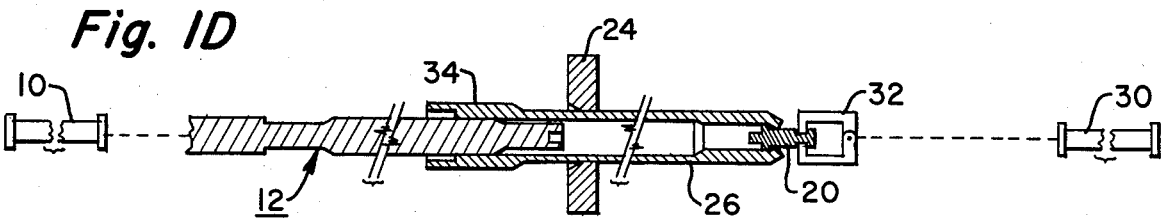

Following this step, the cylinder 30 is pressurized in the opposite sense, thereby causing the gripper 32 to pull the tube 26 through the die 24 from left to right. In this process, the tube 26 as it passes through the die 24, is stripped from the mandrel 12. As shown in FIG. 1D, the left end of the tube 26, which has an inne diameter smaller than that of the center portion 18 of the mandrel 12, is necessarily expanded as at 34. However, with the mandrel 12 stationary, and upon continued pulling of the tube 26 through the die 24, both the inner and outer diameters of the left end of the tube are reduced to produce the configuration shown in FIG. 1E. Finally, the removable plug 20 is dropped out of the left end of the tube, the final configuration being shown in FIG. 1F which is a tube having a constant outer diameter and an inner diameter which is smaller at its opposite ends than at its mid-portion. The necked-down portion 28 can then be cut off.

Figure 1E:
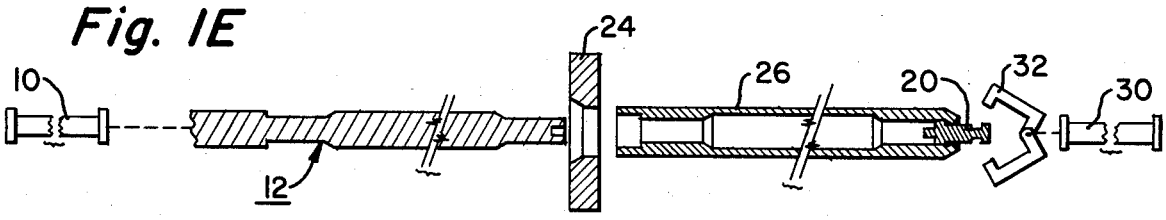
Figure 1F:
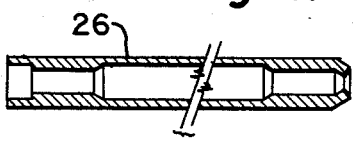

Instead of pulling the tube completely through the die as in FIG. 1E, the process can be stopped as shown in FIG. 1D and the mandrel 12 moved to the left and out of alignment with the die 24, whereupon the tube 26 can be pushed back through the die to the left. In this process, the left end of the tube will have an enlarged outer diameter but an inner diameter which is equal to that of the mid-portion of the tube. The right end of the tube, of course, will still have an increased wall thickness.

Figure 2A:
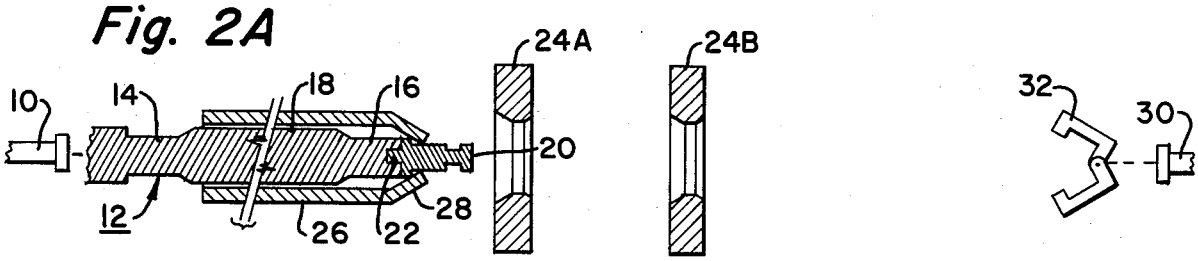
FIGS. 2A–2E illustrate another embodiment of the invention which employs two dies in tandem.
Figure 2B:
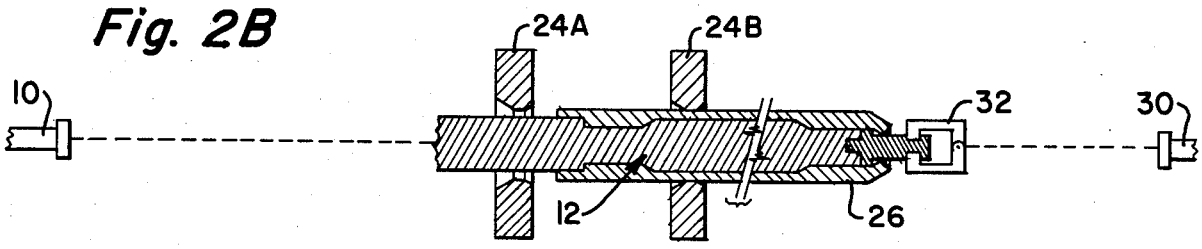
Figure 2C:
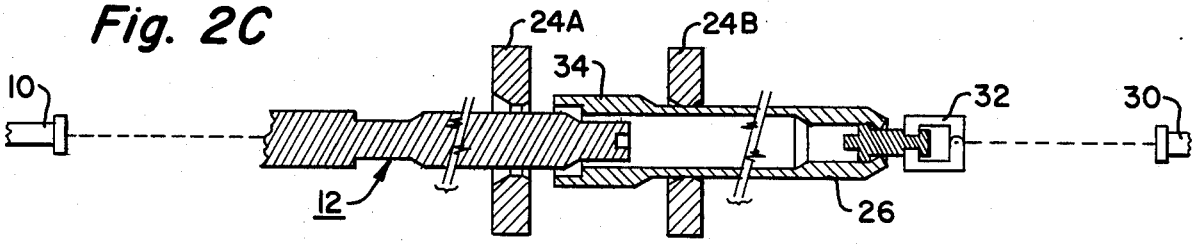
Figure 2D:
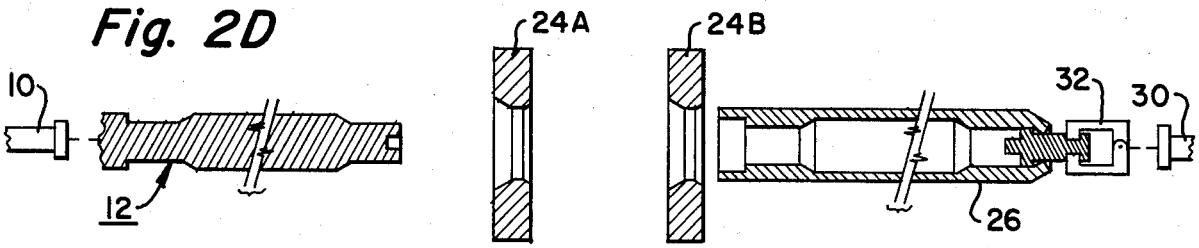
Figure 2E:
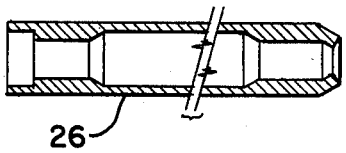

The process shown in FIGS. 2A–2E is similar to that of FIGS. 1A–1F; however in this case two dies 24A and 24B are employed in tandem. The process again starts by threading the tube 26 over the mandrel 12 and the removable plug 20, the tube having a necked-down portion 28 at its right end. As in the embodiment of FIGS. 1A–1F, the tube has a uniform wall thickness throughout its length. The hydraulic cylinder 10 pushes the tube 26 through the dies 24A and 24B as shown in FIG. 2B, the dies being of the same diameter. Up to this point, the process, of course, is the same as that of FIGS. 1A–1F, except that the tube 26 passes through two dies rather than one. There is one rather important difference, and this is the fact that the left end of the tube does not pass through the second die 24B. Following the procedure illustrated by FIG. 2B, the mandrel 12 is then pulled backwardly through the tube by cylinder 10 (FIG. 2C), in which process the left end 34 of the tube is expanded to have an increased outer diameter and an inner diameter which is the same as that of the enlarged diameter portion 18 of the mandrel 12. As the mandrel 12 moves to the left under the force exerted by cylinder 10, the gripper 32 engages the removable plug and locks it in position such that the tube 26 cannot pass backwardly through the die 24B. The cylinder 30 is then pressurized to pull the removable plug 20 and the remainder of the tube 26 through the second die 24B (FIG. 2D), again causing the formation of a tube of constant outer diameter but an inner diameter which is smaller at its ends than at its intermediate portion. Finally, the removable plug 20 is again caused to drop out of the left end of the tube 26 (e.g., by uprighting the tube) to produce the final configuration shown in FIG. 2E.

Still another embodiment of the invention is shown in FIGS. 3A–3H. The process shown in FIGS. 3A–3H is similar to that of FIGS. 1A–1F in that a tube 26 of specified length and uniform wall thickness is initially nosed-down at its right end portion 28 and thereafter passed over a mandrel 12 which has a removable plug 20 at its right end. In this case, however, the mandrel design is such that it resembles a two-sided draw plug connected to a solid mandrel rod 36 whereby reduced diameter portions 14 and 16 are on opposite sides of the plug and a uniform taper acts as a transition between the larger diameter portion 18 of the plug and the reduced diameter ends of the plug.

The hydraulic cylinder 10 pushes the mandrel and the tube through the fixed die 24 until the leading end of the tube conforms to the leading end of the mandrel plug. That is, in initially passing through the die 24, the outer diameter of the tube is reduced and its inner diameter conforms to the shape of the reduced diameter portion 16 and the enlarged portion 18 of the mandrel plug 12 itself. At this point, the cylinder 10 and the mandrel 12 are stopped with the enlarged diameter portion of the mandrel 18 within the die 24. Cylinder 30 is then pressurized to move the gripper 32 to the left as viewed in FIGS. 3A–3H. After the gripper 32 has engaged the reduced diameter portion of the removable plug 20, the cylinder 30 is pressurized in the opposite sense to pull the removable plug 20 and the tube 26 through the die 24. This process continues until the position shown in FIG. 3C. At this point, the restraining pressure within cylinder 10 is reduced while cylinder 30 continues to pull the plug 20 and the tube 26 through the die 24; and in this process it also pulls the mandrel 12 through the die 24 to produce the configuration shown in FIG. 3D.

Figure 3A:
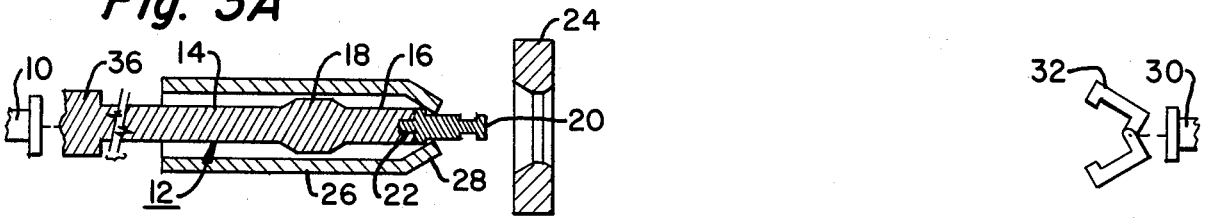
FIGS. 3A–3H illustrate still another embodiment of the invention employing a single die and a modified mandrel.
Figure 3B:
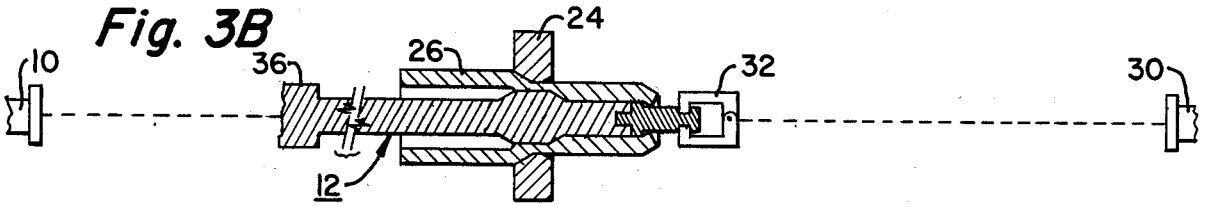
Figure 3C:
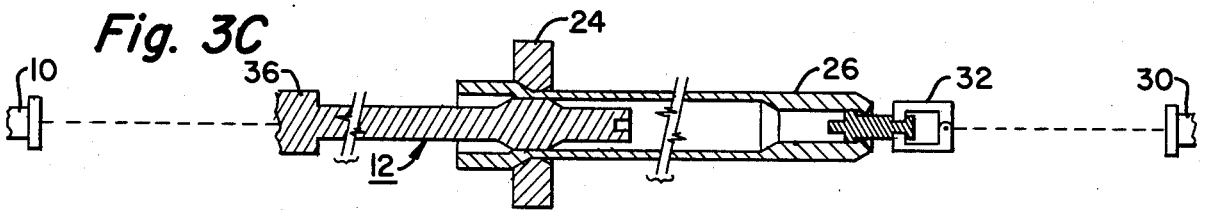
Figure 3D:
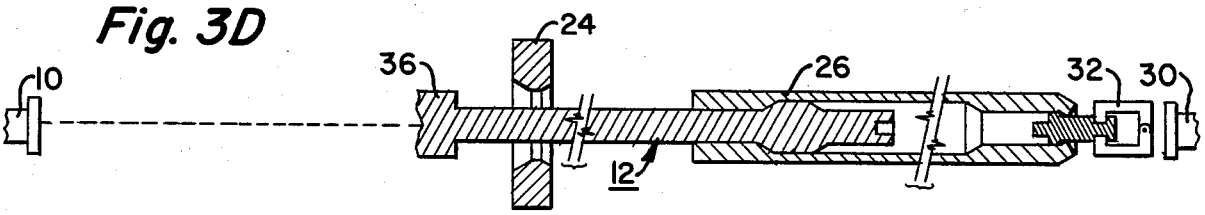
Figure 3E:
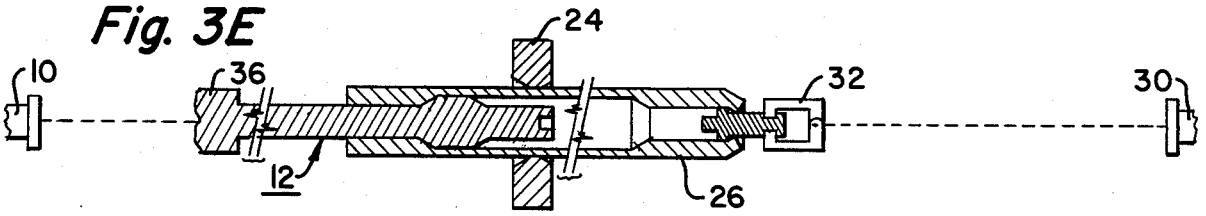
Figure 3F:
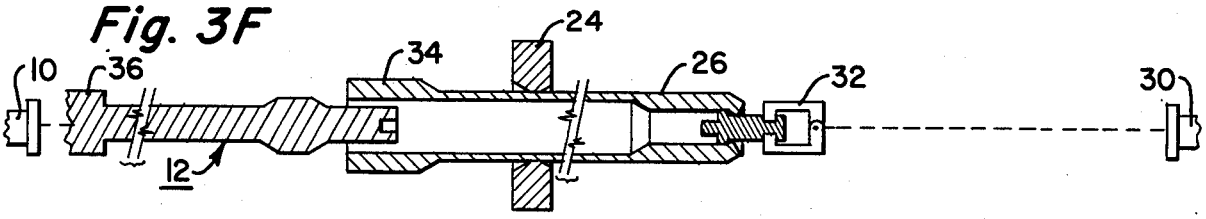
Figure 3G:
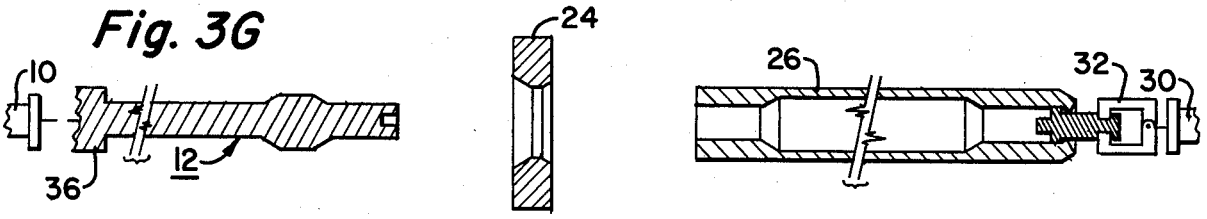
Figure 3H:
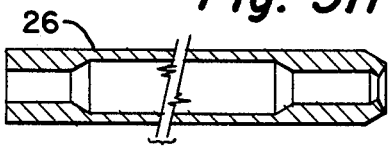

Cylinder 10 is then pressurized to pull the mandrel 12 and tube 26 backwardly through the die 24 until the enlarged portion 18 of the mandrel 12 is on the entry side of the fixed die 24 (FIG. 3E). In the particular embodiment of the invention shown, the cylinder 10 then pulls the mandrel 12 to the left, causing the left end of the tube to expand as the enlarged portion 18 of the mandrel 12 is withdrawn from the tube. Continued pulling of the tube 26 to the right as shown in FIGS. 3F and 3G causes the outer diameter of the tube to be reduced so as to conform with the remainder of the tube; while the inner diameter of the left end is also reduced. This produces the configuration shown in FIGS. 3G and 3H which again is a tube of increased wall thickness at its opposite ends and an intermediate region of the reduced wall thickness.

Finally, the sequence shown in FIGS. 4A–4G is similar to that of FIGS. 3A–3H except that two fixed dies 24A and 24B are employed as in the embodiment of FIGS. 2A–2E. The process shown in FIGS. 4A–4F again starts by nosing-down the right end 28 of the tube 26 of uniform wall thickness. The left end of the tube is then threaded over the mandrel 12, similar to the mandrel shown in FIGS. 3A–3H, the mandrel having a removable plug 20 at its right end.

Figure 4A:
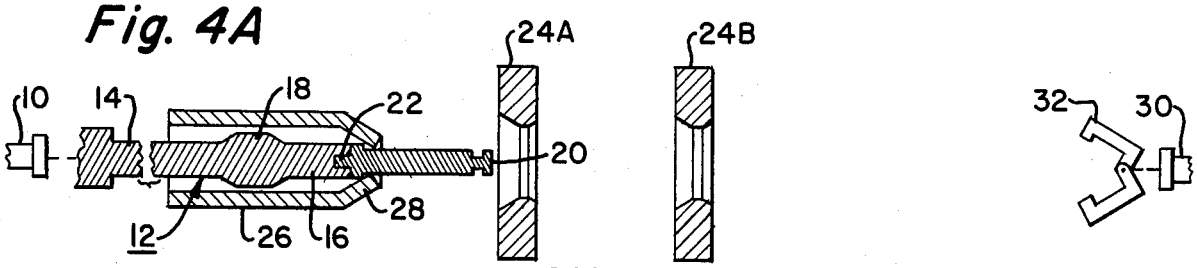
FIGS. 4A–4G illustrate still another embodiment of the invention, similar to that of FIG. 3, but wherein two dies in tandem are employed rather than a single die.
Figure 4B:
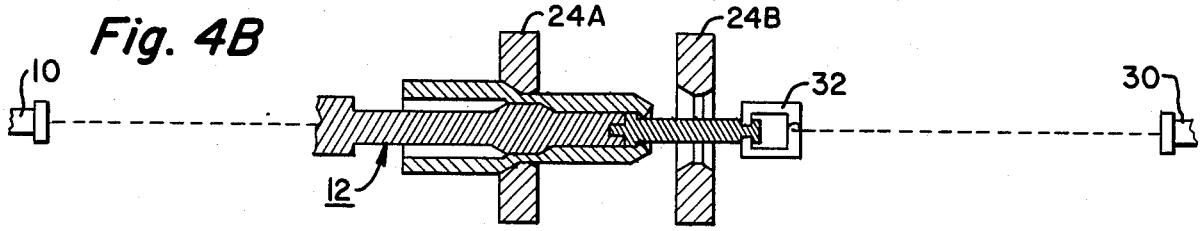
Figure 4C:
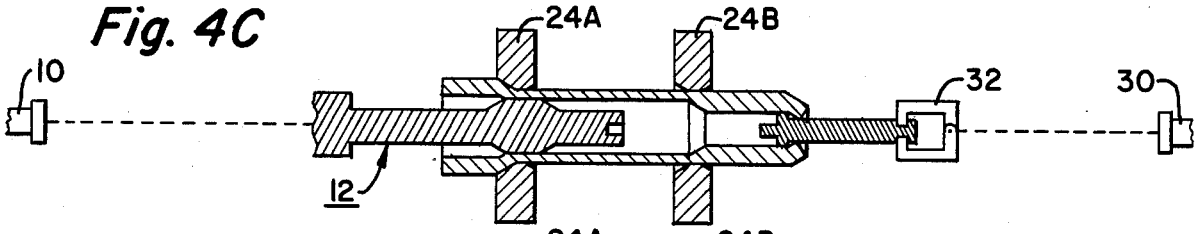
Figure 4D:
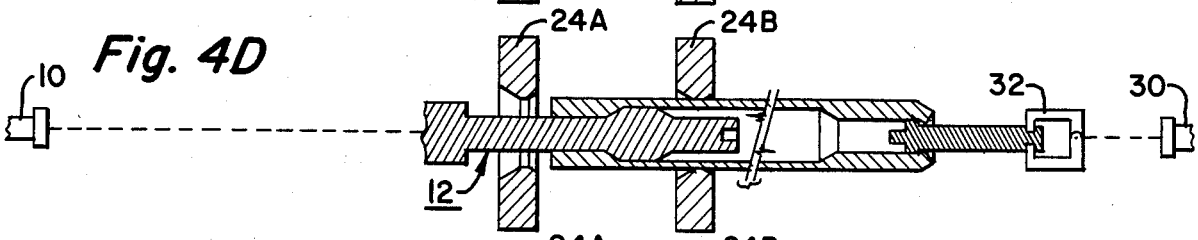
Figure 4E:
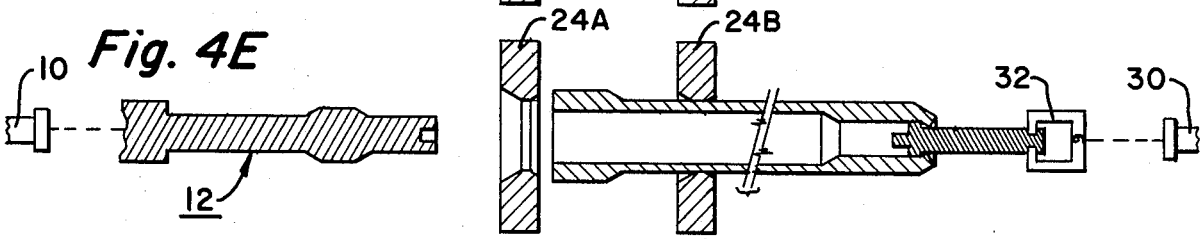
Figure 4F:
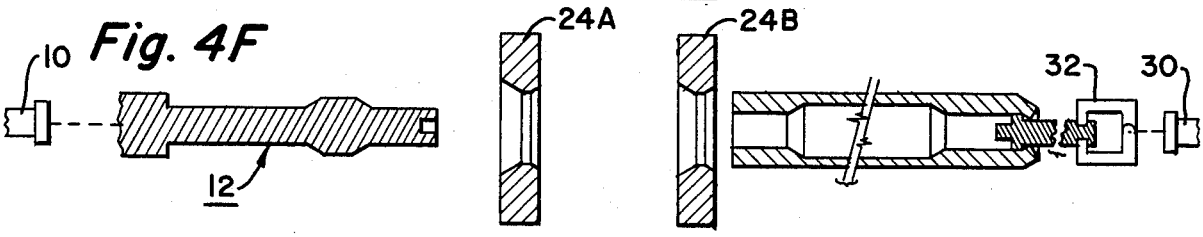
Figure 4G:
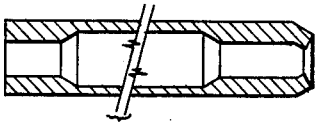

After the mandrel and tube are aligned with the dies 24A and 24B, the cylinder 10 is pressurized to force the mandrel and the tube through die 24A until the removable plug 20 extends beyond the die 24B as shown in FIG. 4B. At this point, and as shown in FIG. 4B, the forward end of the removable plug 20 is grasped by the gripper 32 and the cylinder 30 is pressurized to pull the removable plug and the tube through the die 24B. The mandrel plug 12 remains in the fixed position shown in FIG. 4C. This process continues until the position shown in FIG. 4C. At this point, the restraining pressure within cylinder 10 is exhausted and cylinder 30 continues to pull the plug 20 and tube 26 through dies 24A and 24B and in the process it also pulls the large portion 18 of the mandrel 12 through the die 24A but not through die 24B to produce the configuration shown in FIG. 4D. The mandrel plug 12 is then removed as shown in FIG. 4E; while rightward travel of the gripper 32, the plug 20 and the tube 26 continue to produce the final shape shown in FIG. 4G which is the same final shape as that produced in the preceding sequences.

It will be apparent that with the use of two dies, the outer final diameter of the tube must be constant along its length.

Figure 5A:
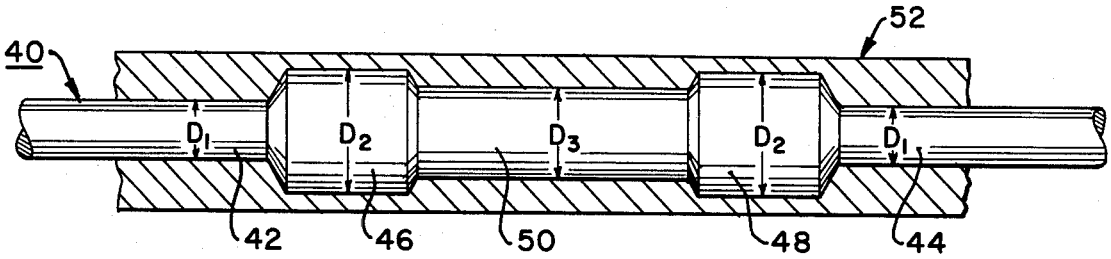
FIGS. 5A and 5B illustrate a procedure for producing a tube of many different internal diameters.
Figure 5B:
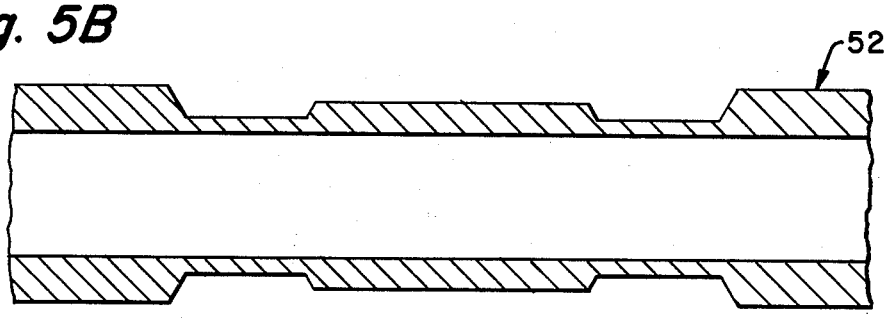

FIGS. 5A and 5B illustrate the manner in which a tube of many different internal diameters can be produced. In this case the mandrel 40 can have, for example, end sections 42 and 44 of diameter $D_1$, enlarged sections 46 and 48 of diameter $D_2$, and an intermediate section 50 of diameter $D_3$. The diameters of sections 42, 44 and 46, 48, however, need not necessarily be the same. When a nosed-down tube 52 is passed over the mandrel 40 and the tube forced through a die as before, the resulting shape will be as shown in FIG. 5A wherein the inner periphery of the tube is forced to conform to the periphery of the mandrel 40 as the metal is plastically deformed and the tube extrudes. Thereafter, when the tube 52 is stripped from the mandrel, its inner periphery will conform to the diameter of the largest mandrel section (in this case, sections 46 and 48); while its outer periphery will protrude at the thicker wall sections as shown in FIG. 5B. In the case shown, those lengths formed by mandrel sections 42 and 44 will proturde further than those formed by sections 46 and 48, for example. Subsequent pulling of the shape shown in FIG. 5B through a die will produce the tube cross section shown in FIG. 5A, but with the mandrel removed. As will be understood, this shape will be a tube of constant outer diameter but of several differing wall thicknesses along its length, the protrusions of FIG. 5B being effectively forced into the interior of the tube as it is pulled through a die.

Figure 6:
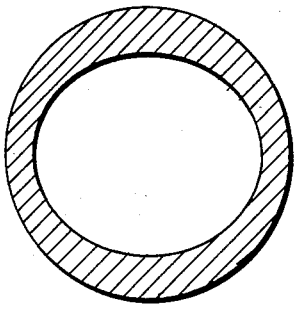
FIGS. 6 and 7 illustrate cross sections of tubes produced in accordance with the invention with mandrels of cross section other than round.
Figure 7:
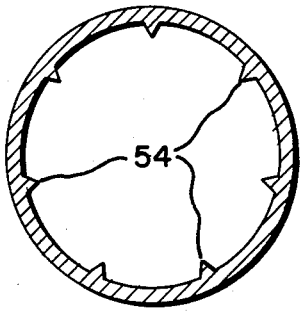

The inner periphery of the finished tube need not necessarily be circular. For example, by using a mandrel of elliptical cross section, the resulting tube cross section will appear as in FIG. 6 wherein the outer periphery is circular and the inner periphery is elliptical. By using a mandrel having longitudinal slots in its periphery, the shape shown in FIG. 7 will result in which ribs 54 protrude inwardly to give the tube greater bending strength for a given wall thickness.

Although the invention has been shown in connection with certain specific embodiments, it will be readily apparent to those skilled in the art that various changes in form and arrangement of parts may be made to suit requirements without departing from the spirit and scope of the invention. The material from which the tube is formed may, for example, be a chromium-molybdenum steel such as AISI 4130. It will also be understood that instead of using a mandrel having a removable plug which extends through the nosed-down end, it is also possible to produce a point on the end of the tube in the same manner as tubes are pointed prior to being drawn on a drawbench. In this latter case, the gripper 32 would grip the pointed end of the tube itself rather than a plug.

I claim as my invention:

1. A method for producing tubing having a variable wall thickness along its length which comprises nosing-down one end of a tube of constant wall thickness, threading the tube over a mandrel until it contacts the nosed-down end, extending the nosed-down end through a die and thereafter passing the tube and the mandrel through the die to cause the tube to extrude while reducing its outer periphery and while causing the inner periphery of the tube to conform to the periphery of the mandrel due to the plasticity of the material from Cwhich the tube is formed, and pulling said tube from the remainder of the mandrel while causing the outer periphery of the tube to pass through a die.

2. The method of claim 1 wherein said mandrel has an intermediate section of cross-sectional area which is greater than the cross-sectional area of at least one of its ends.

3. The method of claim 1 wherein said mandrel has tapered sections between its ends and said intermediate section.

4. The method of claim 1 wherein the tube is initially pushed through first and second dies to cause the tube to extrude while reducing its outer periphery, the tube being thereafter pulled through the second die in tandem with the first.

5. The method of claim 1 wherein said mandrel has a length substantially equal to that of an extruded tube after it has passed through said die.

6. The method of claim 2 wherein said mandrel has a length less than that of an extruded tube after it has passed through said die, the tube and mandrel being pushed through the die until the intermediate section of the mandrel is within the die whereupon the mandrel is fixed in position, and thereafter pulling the tube through the die while the mandrel remains stationary within the die.

7. The method of claim 6 wherein the mandrel remains stationary within the die until all but the trailing end of the tube has passed through the die, whereupon the mandrel is released from its fixed position and both the mandrel and the trailing end of the tube pass through the die.

8. The method of claim 1 wherein said mandrel has an enlarged cross-sectional portion which is other than exactly circular to produce a finished tube of circular outer periphery and an inner periphery which is other than circular.

9. A method for producing tubing having a variable wall thickness along its length which comprises nosing-down one end of a tube of constant wall thickness to produce an opening in said one end which is of smaller cross section than the remainder of the tube, threading the tube over a mandrel having a removable plug at one end thereof until a portion of said plug extends through the opening in said nosed-down end, pushing the tube and the mandrel through a die to cause the tube to extrude while reducing its outer periphery and while causing the inner periphery of the tube to conform to the periphery of the mandrel due to the plasticity of the material from which the tube is formed, and pulling said removable plug and said tube from the remainder of the mandrel while causing the outer periphery of the tube to pass through a die.

10. The method of claim 9 wherein only said portion of the plug extends through said opening in the nosed-down end, the remainder of the plug being of a cross-sectional area which prevents it from passing through said opening in the nosed-down end.

11. The method of claim 10 where the step of pulling said removable plug and said tube from said mandrel expands both the inner and outer peripheries of the end of the tube opposite the removable plug whereby the tube has a constant outer periphery except at the end of the tube opposite the removable plug where the periphery is greater, said tube having a reduced inner periphery at the end through which the removable plug extends but a constant inner periphery throughout the remainder of the tube.

12. The method of claim 11 including the step of pulling said end of the tube opposite said removable plug through a die to produce a finished tube having a constant outer periphery and a reduced inner periphery at its ends opposite the intermediate portion of the tube.

13. The method of claim 9 wherein said tube is pushed through a single die, and including the step of retracting the tube through said die before said removable plug and the tube are pulled from the mandrel while the tube again passes through said single die.

* * * * *